US006267525B1

(12) United States Patent
Wu

(10) Patent No.: US 6,267,525 B1
(45) Date of Patent: Jul. 31, 2001

(54) BOARD TO BOARD COUPLING STRUCTURE

(76) Inventor: Su-Lan Wu, 5F-23, 70, Fu-Shing Road, Taoyuan (TW)

( * ) Notice: Subject to any disclaimer, the term of this patent is extended or adjusted under 35 U.S.C. 154(b) by 0 days.

(21) Appl. No.: 09/378,955

(22) Filed: Aug. 23, 1999

(51) Int. Cl.[7] ..... A47G 5/00; E04H 1/00; E04C 2/34

(52) U.S. Cl. ..... 403/49; 403/217; 403/174; 160/135; 52/235; 52/481.2

(58) Field of Search ..... 160/135; 403/49, 403/170, 174, 178, 217; 52/235, 481.2, 481.1, 761, 800.12

(56) References Cited

U.S. PATENT DOCUMENTS 3,605,851 * 9/1971 Miles et al. ..... 160/135
3,762,116 * 10/1973 Anderson et al. ..... 160/135
3,766,692 * 10/1973 Stark ..... 160/135
3,809,142 * 5/1974 Bleeker ..... 160/135
3,971,182 * 7/1976 Donahue et al. ..... 160/135
3,987,838 * 10/1976 LaGue et al. ..... 160/135
4,601,145 * 7/1986 Wilcox .

* cited by examiner

*Primary Examiner*—Lynne H. Browne
*Assistant Examiner*—Tomlyne A Malcolm
(74) *Attorney, Agent, or Firm*—Dougherty & Troxell

(57) ABSTRACT

A board to board coupling structure coupled between at least two panel assemblies, the board to board coupling structure including a tubular shaft, two locating plates respectively mounted in a longitudinal groove at the tubular shaft, two inner socket assemblies respectively mounted on the tubular shaft, two end caps respectively mounted on the tubular shaft, two outer sockets, a plurality of hook plates, and a plurality of plug plates. The hook plates are fixed to the at least two panel assemblies, each having a hooked portion respectively hooked on a top notch at an outer race at one inner socket and a notch at an upright flange at one outer socket. The plug plates are fixed to the at least two panel assemblies, each having a plug portion inserted in between the socket body and outer race at one inner socket and engaged into the notch at the upright flange at one outer socket. The end caps each have toothed blocks inserted in gaps between threads at the socket body of each inner socket and then respectively forced into engagement with the threads at the socket body of each inner socket.

2 Claims, 8 Drawing Sheets

BOARD TO BOARD COUPLING STRUCTURE

BACKGROUND OF THE INVENTION

The present invention relates to a board to board coupling structure, and more particularly to such a board to board coupling structure, which enables a plurality of panel assemblies to be coupled to one another, forming a folding collapsible display rack, screen, or partition wall.

There is a known board to board coupling structure for coupling panel assemblies into a folding collapsible display rack or the like. This coupling structure comprises a plurality of sliding rails and clamping plates. Each sliding track is inserted into a sliding groove at the frame structure of one panel assembly, and then is fixedly secured thereto at the desired elevation. The clamping plates are respectively clamped on a tubular shaft about which the installed panel assemblies are turned. The main drawback of this structure board to board coupling structure is that the clamping plates wear quickly with use. When the clamping plates start to wear, the coupled panel assembly may displace downwards with the respective clamping plates relative to the tubular shaft. Further, when the clamping plates start to wear, they tend to be disconnected from the tubular shaft by an external force.

SUMMARY OF THE INVENTION

The present invention has been accomplished to provide a board to board coupling structure, which eliminates the aforesaid problems. According to one aspect of the present invention, the board to board coupling structure comprises a tubular shaft, two locating plates respectively mounted in a longitudinal groove in the tubular shaft, two inner socket assemblies respectively mounted on the tubular shaft, two end caps respectively mounted on two distal ends of the tubular shaft, two outer sockets, a plurality of hook plates, and a plurality of plug plates. the hook plates are respectively fixed to the at least two panel assemblies, each having a hooked portion respectively hooked on a top notch at an outer race at one inner socket and a notch at an upright flange at one outer socket, the plug plates are respectively fixed to at least two panel assemblies, each having a plug portion inserted in between the socket body and outer race at one inner socket and engaged into the notch at the upright flange at one outer socket. The end caps each have toothed blocks respectively inserted in gaps between threads at the socket body of each inner socket and then are respectively forced into engagement with the threads on the socket body of each inner socket.

According to another aspect of the present invention, the board to board coupling structure further comprises at least one coupling member respectively hooked on the inside annular groove at outer sockets, the at least one coupling member having a plug hole for the positioning of the hooked portion of one hook plate and the plug portion of one plug plate. Because the connection areas between the hooked plates and plug plates and the inner sockets are respectively spaced from the connection areas between the inner sockets and the outer sockets, the assembly and disassembly procedures of the present invention are simple and, the outer sockets can be positively positioned on the inner sockets.

DETAILED DESCRIPTION OF THE PREFERRED EMBODIMENT

Figure 1:
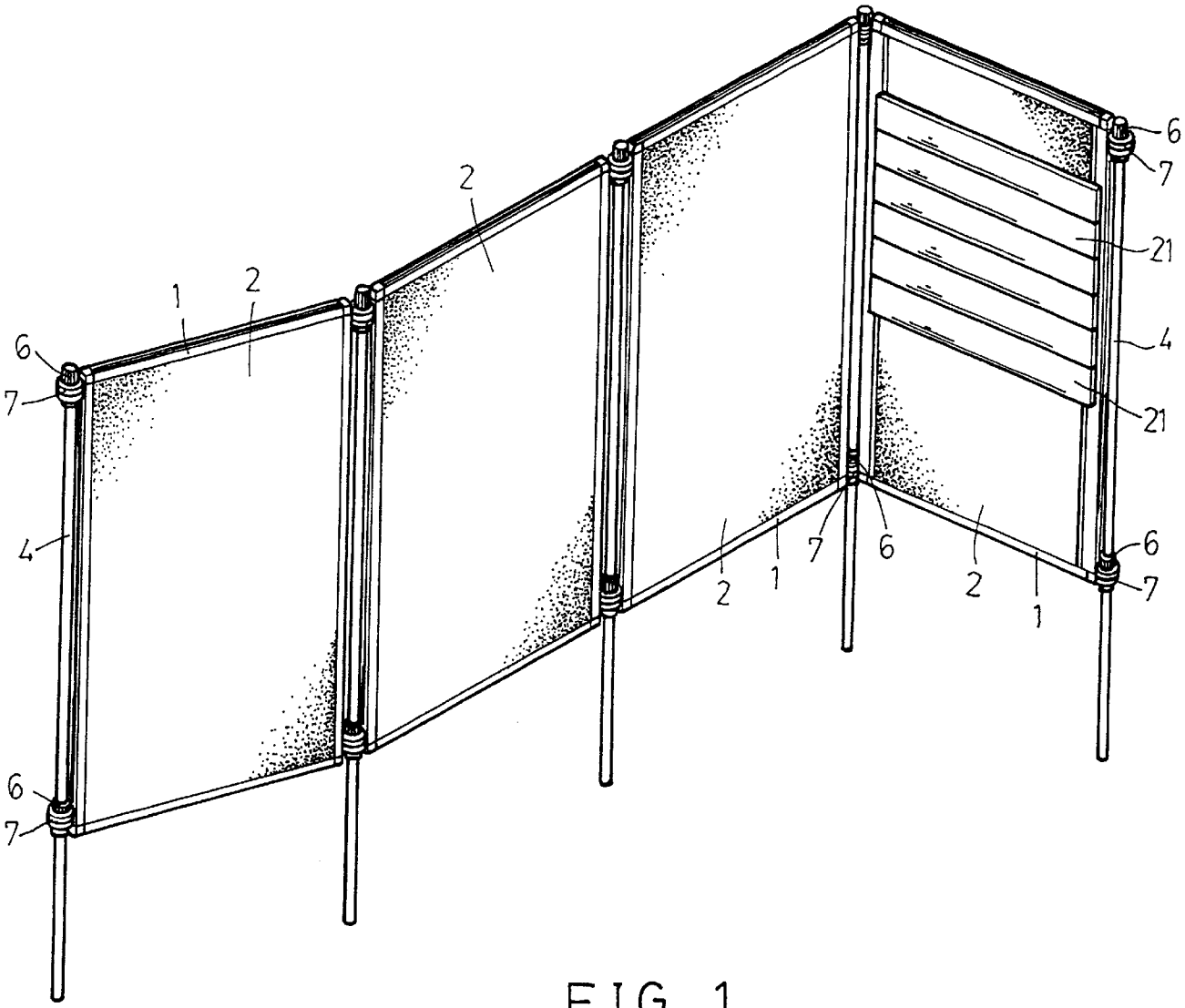
FIG. 1 is a perspective view showing an application example of the present invention.
Figure 2:
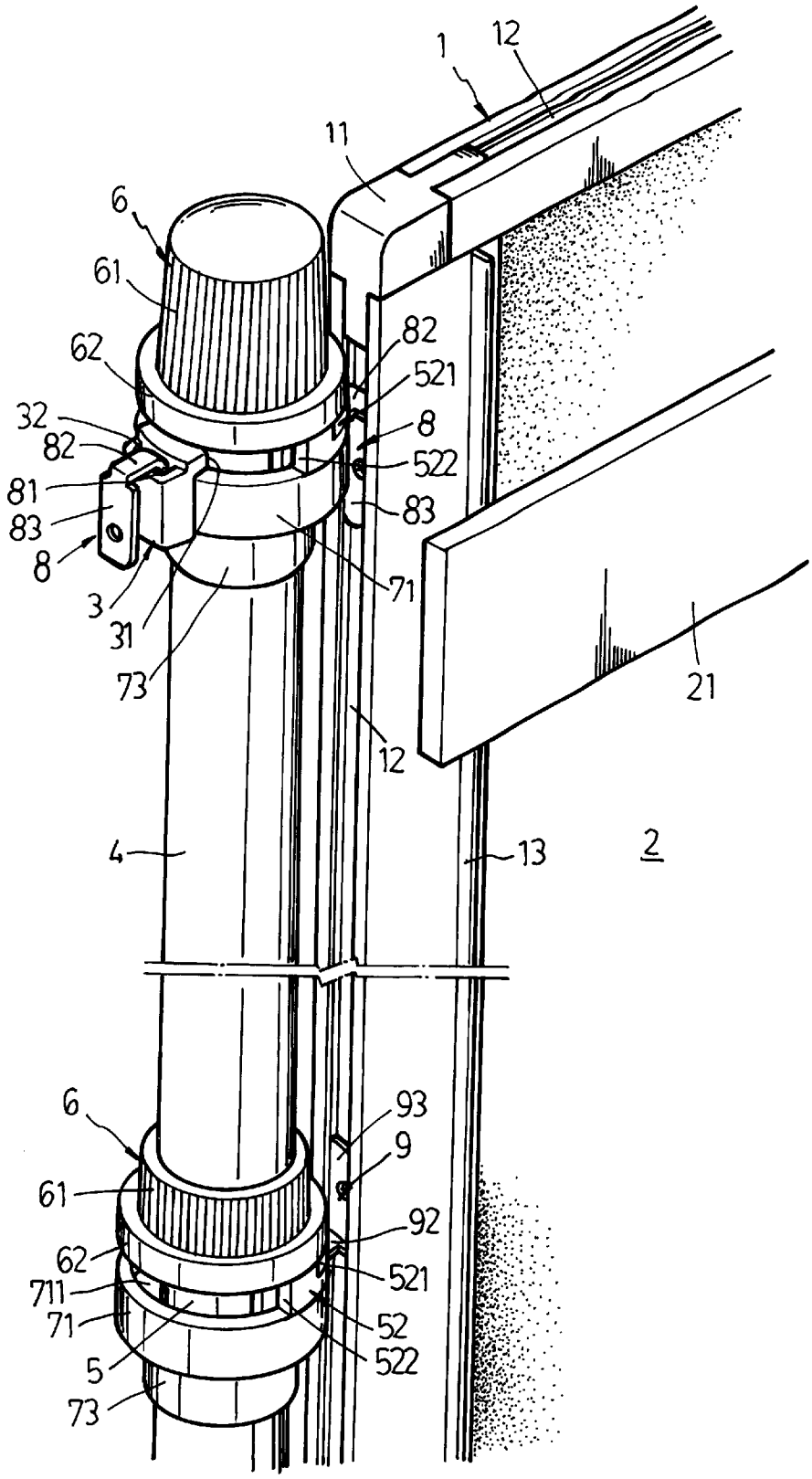
FIG. 2 is a perspective view showing a coupling structure fastened to the frame structure at one panel assembly according to the present invention.
Figure 3:
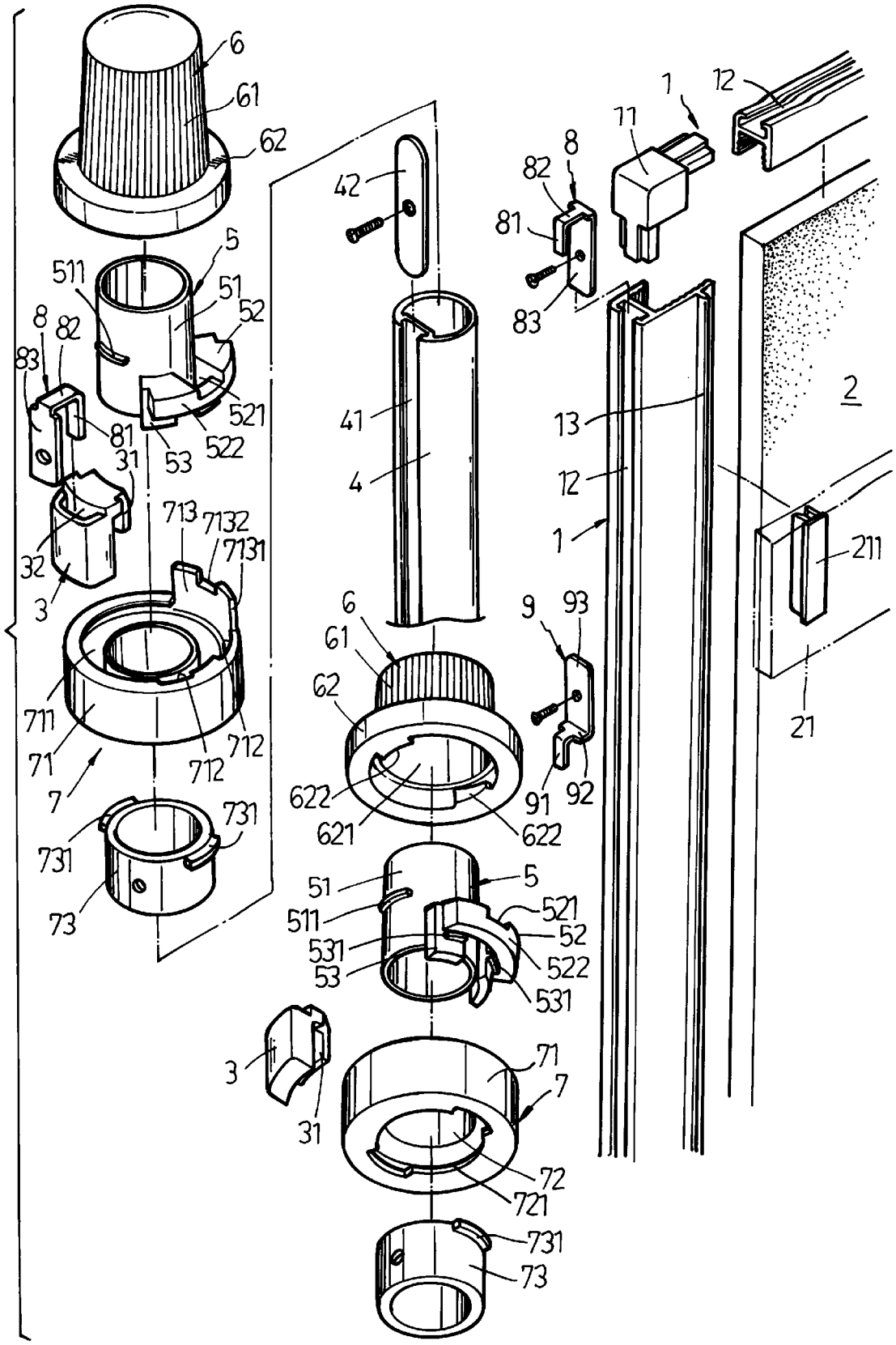
FIG. 3 is an exploded view of FIG. 2.

Referring to FIG. 1, a plurality of panel assemblies 2 are coupled to one another forming a folding collapsible display rack. The folding collapsible display rack can also be used as a screen or partition wall. The panel assemblies 2 each comprise a frame structure composed of four rails (a horizontal top rail, a horizontal bottom rail, and two vertical side rails) 1 and four angle connectors 11. Display slats 21 are hung on the panel assemblies 2 to show different marks, signs, words, etc.

Referring to FIGS. from 2 through 4 and FIG. 1 again, the display slats 21 each comprise two clamps 211 near two opposite ends for fastening to a respective longitudinal flange 13 at the two vertical side rails 1 of the frame structure at one panel assembly 2. A coupling structure is provided for enabling one panel assembly 2 to be coupled to another. The coupling structure comprises a plurality of connecting members 3, a tubular shaft 4, two inner socket assemblies 5, two end caps 6, two outer sockets 7, two hook plates 8, and two plug plates 9. The tubular shaft 4 comprises a longitudinal groove 41 of substantially C-shaped cross section extended between two distal ends thereof on the outside. Further two locating plates 42 are respectively mounted in the longitudinal groove 41 at the tubular shaft 4. Each inner socket assembly 5 comprises a socket body 51, an outer race 52, and an arched block 53 connected between the socket body 51 and the outer race 52. The socket body 51 has an inner diameter greater than the outer diameter of the tubular shaft 4. 10 When the socket body 51 is sleeved onto the tubular shaft 4, it can be moved along the tubular shaft 4, and turned about the tubular shaft 4. The end caps 6 are respectively covered on the two distal ends of the tubular shaft 4. Each end cap 6 comprises a cap body 61 defining a receiving chamber 621, a rim 62 formed integral with the cap body 61 around the receiving chamber 621, and two toothed blocks 622 bilaterally raised from the inside wall of the rim 62 within the receiving chamber 621. When the cap body 61 is covered on one end of the tubular shaft 4, the rim 62 is stopped against the outer race 52 of one inner socket assembly 5. The outer sockets 7 each comprise an annular base 71 defining an open chamber 72, and an annular retaining member 73 mounted in the open chamber 72 within the annular base 71 and fixedly fastened to one locating plate 42 in the longitudinal groove 41 at the tubular shaft 4 by a screw. The hook plates 8 each comprise a mounting base 83, a hooked portion 81, and an angled connecting portion 82 connected between the mounting base 83 5 and the hooked portion 81. The mounting base 83 is inserted into a longitudinal sliding groove 12 at one side rail 1 at one panel assembly 2, and then fixedly secured thereto at the desired location. The plug plates 9 each comprise a vertical plug portion 91 at a bottom side, a vertical mounting portion 93 at a top side, and a horizontal connecting portion 92 connected between the vertical plug portion 91 and the vertical mounting portion 93 on the middle. The vertical mounting portion 93 is inserted into a longitudinal sliding groove 12 at one side rail 1 at one panel assembly 2, and then fixedly secured thereto at the desired location.

Figure 5:
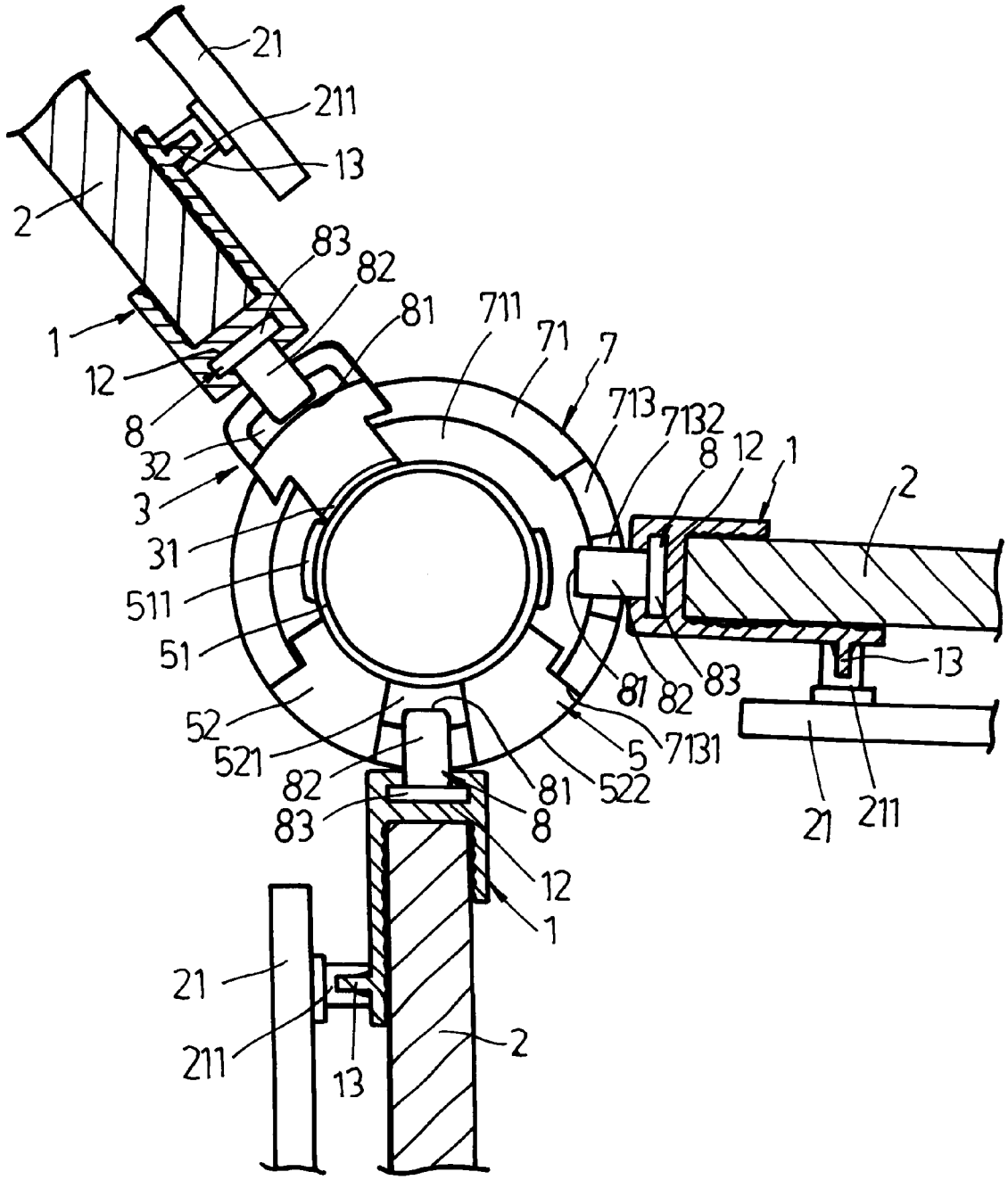
FIG. 5 is a transverse view in section showing an application example of the present invention.
Figure 7:
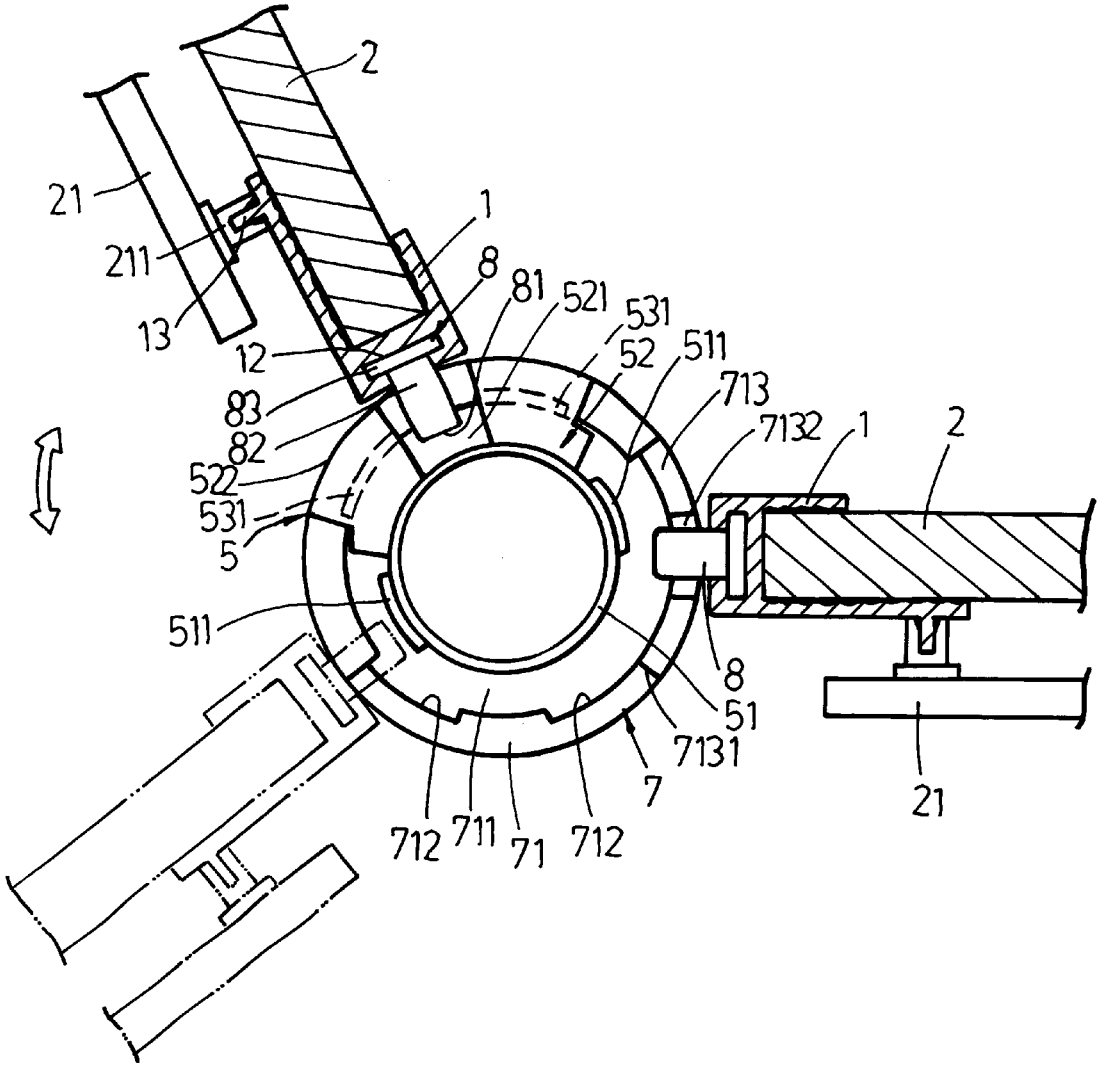
FIG. 7 is a transverse view in section showing an application example of an alternate form of the present invention.

Referring to FIG. 5 and FIGS. from 2 through 4 again, the socket body 51 of each inner socket 5 comprises threads 511 raised from the outside wall thereof. The outer race 52 has a top notch 521 (see also FIG. 7). When one end cap 6 is mounted on one end of the tubular shaft 4, the cap body 61 of the end cap 6 covers on the socket body 51 of one inner socket 5. The annular base 71 of each outer socket 7 comprises an inside annular groove 711, two inside notches 712 bilaterally disposed on the inside in communication with the inside annular groove 711. The arched block 53 of each inner socket 5 has outer threads 531, which are inserted with the arched block 53 through the inside notches 712, and then engaged into the inside annular groove 711 upon rotary motion of the arched block 53 relative to the annular base 71. The retaining member 73 is fixedly fastened to one locating plate 42 at the tubular shaft 4 and inserted into the open chamber 72 at the base 71, having a flanges 731 raised from the periphery and hooked on an inside flange 721 at the base 71.

The hooked portion 81 of one hook plate 8 is hooked on the top notch 521 at the outer race 52 at one socket 5. The hooked portion 81 of the other hook plate 8 is hooked on a notch 15 7132 at an upright flange 713 at the base 71 at one outer socket 7. The plug portion 91 of one plug plate 9 is inserted in between the socket body 51 and outer race 52 at one inner socket 5. The plug portion 91 of the other plug plate 9 is engaged into the notch 7132 at the upright flange 713 at the base 71 at one outer socket 7.

Figure 4:
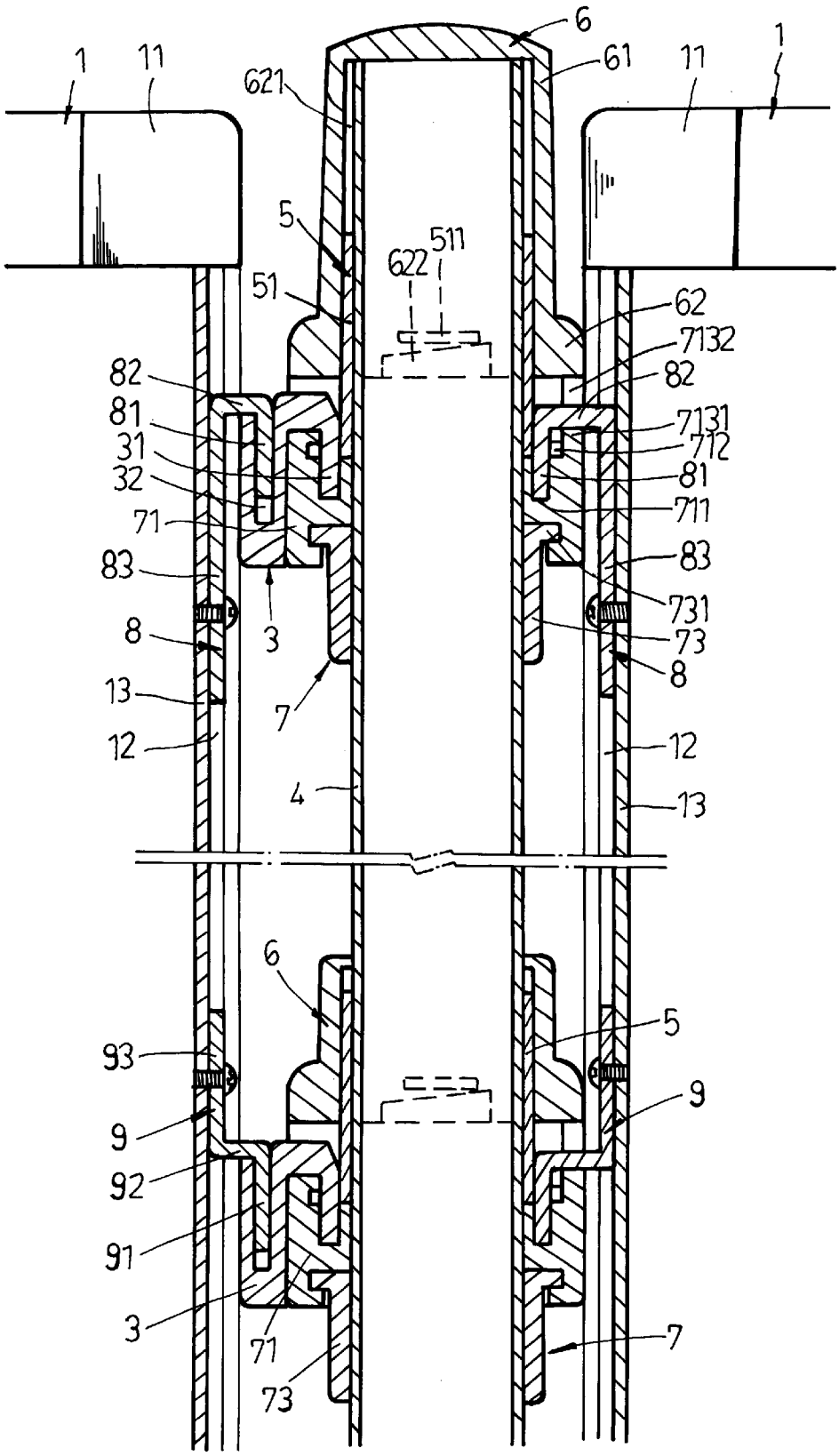
FIG. 4 is a longitudinal view in section of the present invention.
Figure 6:
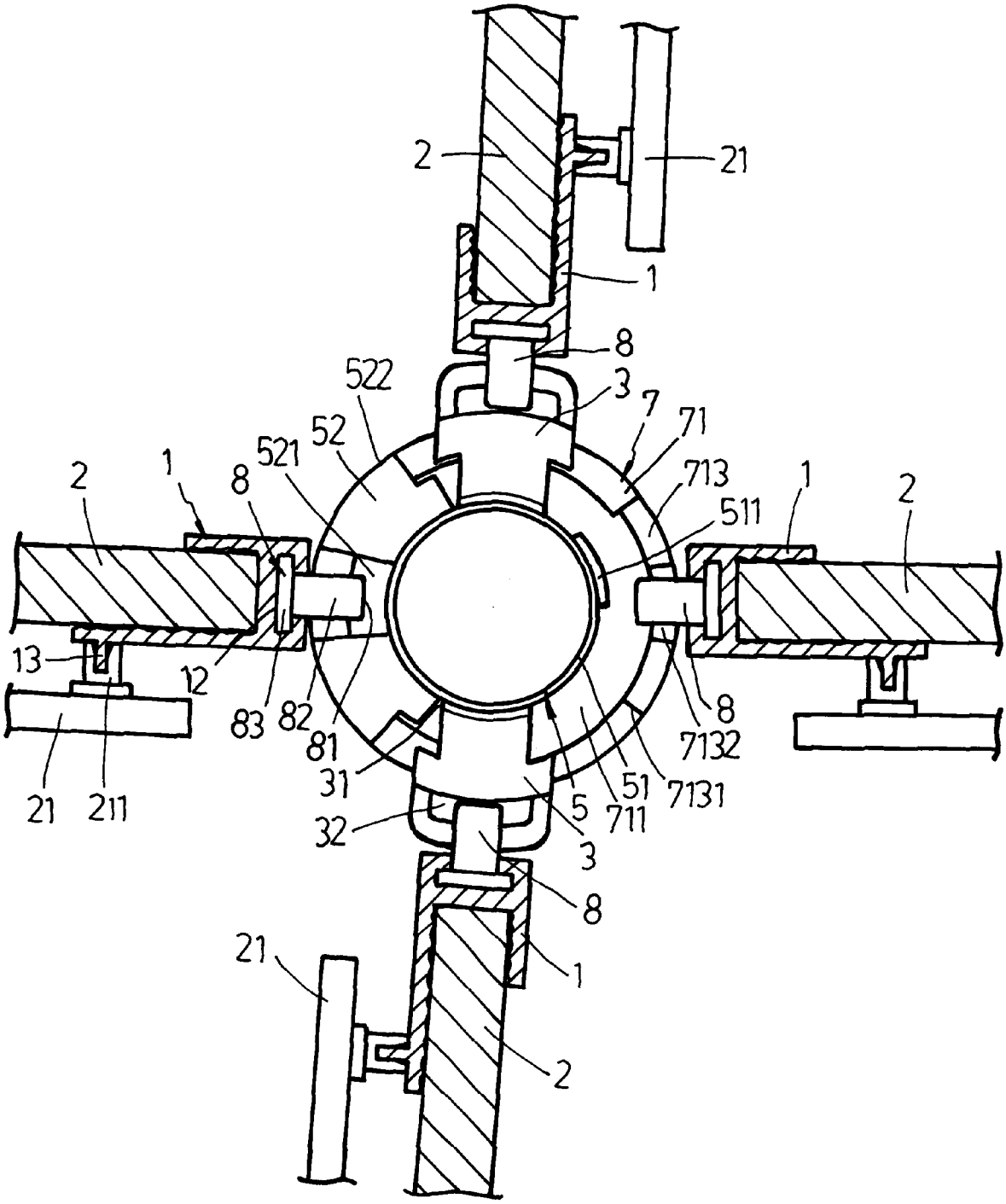
FIG. 6 is a transverse view in section showing another application example of the present invention.

Referring to FIG. 6 and FIGS. 4 and 5 again, because the inner sockets 5 and the outer sockets 7 are respectively coupled to the hook plates 8 and the plug plates 9, the coupled panel assembly 2 can be turned about the tubular shaft 4 to the desired angular position. One or two coupling members 3 may be coupled to each outer socket 7. The coupling member 3 is hooked on the inside annular groove 711, having a plug hole 32 for the positioning of the hooked portion 81 of each hook plate 8 and the plug portion 91 of each plug plate 9. Thus, two or four panel assemblies 2 can be coupled to and turned about the tubular shaft 4.

Figure 8:
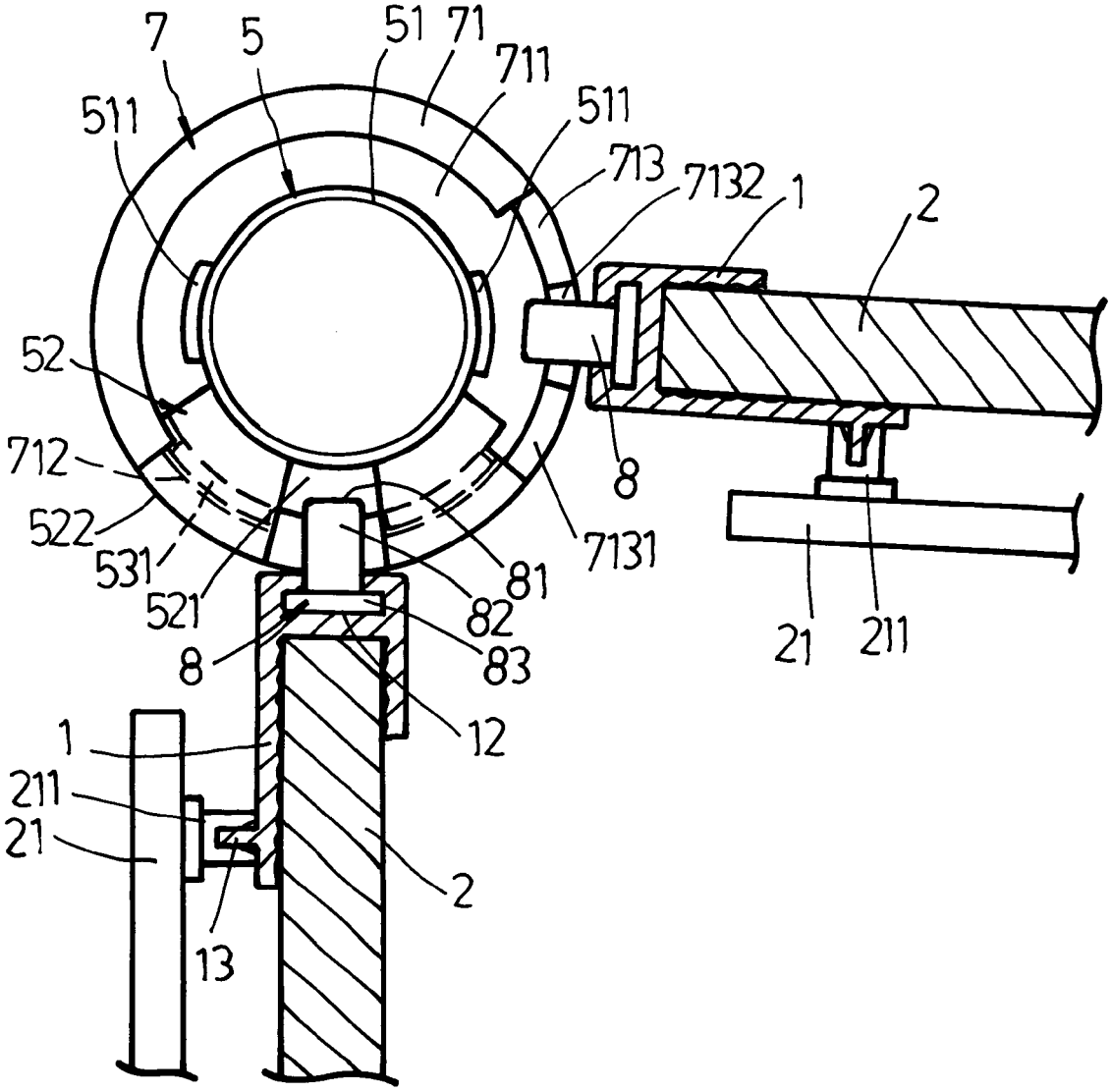
FIG. 8 is a transverse view in section showing another application example of the alternate form of the present invention.

Referring to FIG. 8, the frame structure (rails) 1 of the panel assembly 2 is supported of two corner edges 522 at the outer race 52 at each inner socket 5 and the two corner edges 7131 of the upright flange 713 at the base 71 at each outer socket 7 when moved to adjust its position. The toothed blocks 622 of one end cap 6 are inserted in gaps between the threads 511 of the socket body 51 of the corresponding inner socket 5, and then the end cap is rotated through an angle relative to the inner socket 5, enabling the toothed blocks 622 to be respectively forced into engagement with the threads 511.

As indicated above, by means of the notch 521 at the outer race 52 at each inner socket 5 and the notch 7132 at the upright flange 713 at the base 71 at each outer socket 7 and respective rotary motion of the inner sockets 5 and the outer sockets 7, the angular position adjustment of one panel assembly 2 does not affect the positioning of another panel assembly 2. Because the connection areas between the hooked plates 8 and plug plates 9 and the inner sockets 5 are respectively spaced from the connection areas between the inner sockets 5 and the outer sockets 6, the assembly and disassembly procedures of the present invention are simple. Further, the outer sockets 6 can be positively positioned on the inner sockets 5.

It is to be understood that the drawings are designed for purposes of illustration only, and are not intended for use as a definition of the limits and scope of the invention disclosed.

What the invention claimed is:

1. A board to board coupling structure for coupling at least two panel assemblies, each having a rectangular frame structure composed of a horizontal top rail, a horizontal bottom rail, two vertical side rails, and four angle connectors connected between said horizontal top and bottom rails and said vertical side rails in four corners, the board to board coupling structure comprising:

a tubular shaft having a longitudinal groove of substantially C-shaped cross section extending between two opposite ends thereof on the outside;

two locating plates fixedly mounted in the longitudinal groove at desired locations;

two inner socket assemblies respectively mounted on said tubular shaft, each of said inner socket assemblies comprising a socket body, an outer race, and an arched block connected between said socket body and said outer race, said socket body having threads raised from an outside wall thereof, said outer race having a top notch;

two end caps respectively mounted on said tubular shaft, each of said end caps comprising a cap body having a receiving chamber, a rim formed integral with said cap body extending around said receiving chamber, and two toothed blocks extending from said rim into said receiving chamber;

two outer sockets, each of said outer sockets comprising an annular base defining an open chamber, the annular base having an upright flange with a notch therein, and an annular retaining member mounted in said open chamber within said annular base and fixedly fastened to one of the two locating plates;

a plurality of hook plates, each of said hook plates comprising a mounting base configured to be fixedly fastened to one vertical side rail, a hooked portion, and an angled connecting portion connected between said mounting base and said hooked portion; and a plurality of plug plates, each of said plug plates comprising a vertical plug portion at a bottom side, a vertical mounting portion at a top side configured to be fixedly fastened to one vertical side rail, and a horizontal connecting portion connected between said vertical plug portion and said vertical mounting portion;

wherein the hooked portion of one of said plurality of hook plates is hooked on the top notch of the outer race of a first one of said two inner sockets and the hooked portion of another of said plurality of hook plates is hooked on the notch in the upright flange of a first one of said two outer sockets, the plug portion of one of said plurality of plug plates is inserted in between the socket body and outer race of a second one of said two inner sockets and the plug portion of another of said plurality of plug plates is engaged into the notch in the upright flange of a second one of said two outer sockets, and the toothed blocks of said two end caps are respectively inserted in gaps between the threads of the socket body of said two inner sockets and then into engagement with the threads of the socket body of said two inner sockets, enabling said at least two panel assemblies to be respectively coupled to and turned about said tubular shaft.

2. The board to board coupling structure of claim 1 further comprising an inside annular groove in each of the two outer sockets and at least one coupling member respectively hooked on the inside annular groove, said at least one coupling member having a plug hole for engagement with one of the hooked portion of one of the plurality of hook plates and the plug portion of one of the plurality of plug plates.

* * * * *